United States Patent [19]

Fallen

[11] 4,155,138

[45] May 22, 1979

[54] FLOOR BUFFING MACHINE

[76] Inventor: Burke F. Fallen, 1315 Buck St., Eugene, Oreg. 97402

[21] Appl. No.: 869,216

[22] Filed: Jan. 13, 1978

Related U.S. Application Data

[62] Division of Ser. No. 701,522, Jul. 1, 1976, Pat. No. 4,069,538.

[51] Int. Cl.[2] ..... A47L 11/14

[52] U.S. Cl. ..... 15/98; 51/177

[58] Field of Search ..... 15/28, 29, 49 R, 50 R, 15/52, 87, 98, 385; 51/177

[56] References Cited

U.S. PATENT DOCUMENTS

| | | | |
|---|---|---|---|
| 1,195,555 | 8/1916 | Campbell | 51/177 |
| 1,601,087 | 9/1926 | Simpson | 15/49 R |

FOREIGN PATENT DOCUMENTS

| | | | |
|---|---|---|---|
| 1068697 | 5/1967 | United Kingdom | 15/49 R |

*Primary Examiner*—Edward L. Roberts

*Attorney, Agent, or Firm*—Warren, Chickering & Grunewald

[57] ABSTRACT

A floor buffing machine having a pair of coaxial floor-engaging wheels for movement of the machine over the floor to be buffed, a motor drive, and a floor buffing pad support structure mounted to one side of the wheels, the machine pivoting around the wheel axis to position the buffing pad in contact with the floor, and wherein the pad supporting means provides automatic self-adjustment of the pad into parallelism with the floor as the thickness of the pad changes with wear, thus maintaining full surface pad contact with the floor and obtaining a prolonged pad life.

3 Claims, 2 Drawing Figures

FLOOR BUFFING MACHINE

This application is a division of application Ser. No. 701,522, filed July 1, 1976, now U.S. Pat. No. 4,069,538.

BACKGROUND OF THE INVENTION

The invention relates to power-driven floor buffing machines of the type shown in my U.S. Pat. No. 3,977,421 and as disclosed in my co-pending application, Ser. No. 701,522.

Prior art machines to which the present invention relates are normally supported on a pair of coaxial floor-engaging wheels providing movement of the machine over the floor to be buffed, and the machine is rocked about the wheels as an axis to lower the motor-driven buffing pad to the floor. Common buffing pads are of disc shape with the pad mounted for rotation about its center and designed for flat, full face engagement with the floor in its lowered buffing position. As the pad wears thinner, however, a further rocking of the machine is required to lower the pad to the floor, and as the machine rotates around the supporting wheels, the angle of the pad support changes, thus moving the pad out of parallelism with the floor and producing premature wearing of the peripheral portion of the pad.

SUMMARY OF INVENTION

An object of the present invention is to provide improved means for supporting the buffing pad during its high speed rotation, enabling it to automatically self-adjust in all conditions of use into parallel relation with the floor and thus constantly provide full surface face-to-face engagement with the floor throughout the full life of the pad and regardless of the thickness of the pad. Accordingly, a feature of the present invention is the provision of a floor buffing machine which will afford both improved floor buffing action and improved buffing pad life.

The invention possesses other objects and features of advantage, some of which of the foregoing will be set forth in the following description of the preferred form of the invention which is illustrated in the drawings accompanying and forming part of this specification. It is to be understood, however, that variations in the showing made by the said drawings and description may be adopted within the scope of the invention as set forth in the claims.

DETAILED DESCRIPTION OF THE INVENTION

Figure 1:
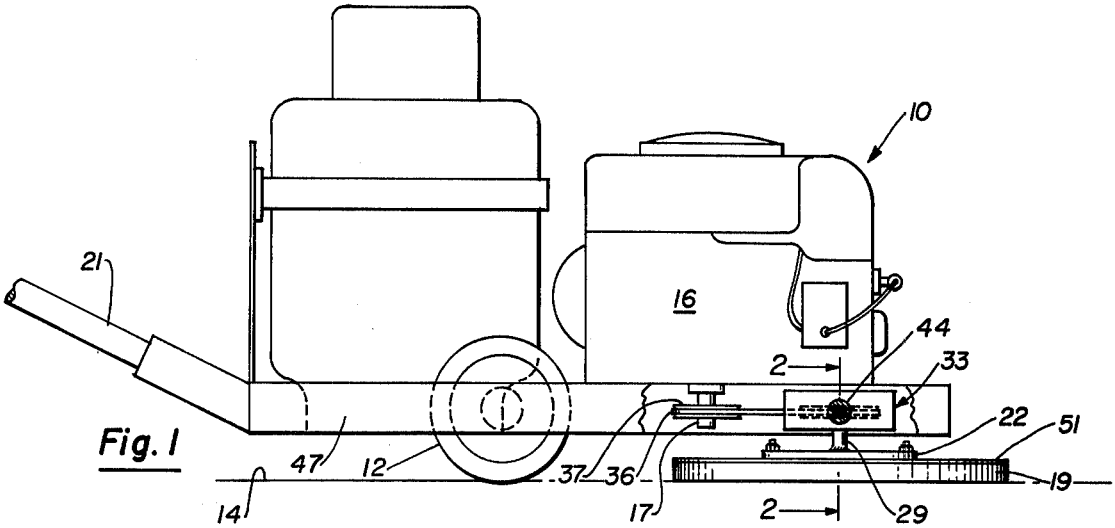
FIG. 1 is a side elevation of a floor buffing machine constructed in accordance with the present invention, with a portion broken away and shown in section.
Figure 2:
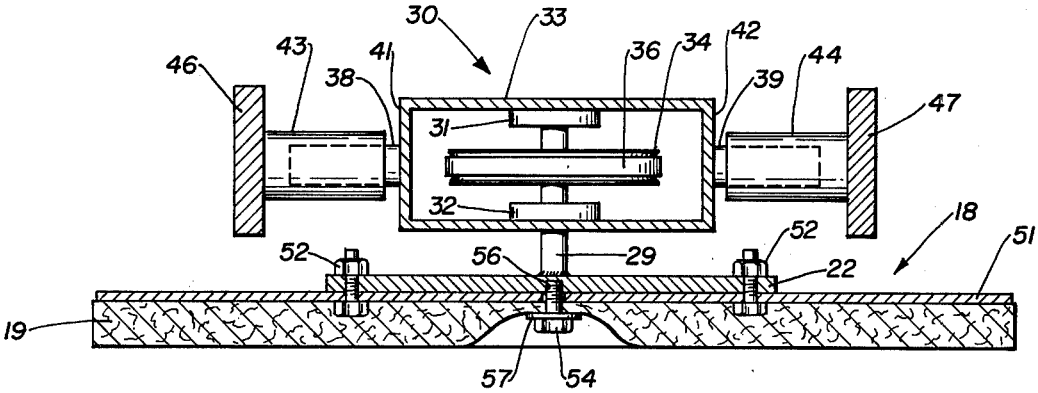
FIG. 2 is a fragmentary cross-sectional view on an enlarged scale of the pad support structure taken substantially on the plane of line 2—2 of FIG. 1.

The floor buffing machine 10 of the present invention comprises, briefly, a pair of coaxial floor-engaging wheels 12 for movement of the machine over the floor 14 to be buffed, a motor drive consisting of motor 16 and its drive shaft 17, and a floor buffing pad support structure 18 mounted to one side of the wheels 12, forwardly of their common axis, so that the machine will pivot around the wheel axis to position the buffing pad 19 in contact with the floor. A handle 21 extends rearwardly from the machine for use by the operator in propelling the machine over the floor and in rocking the machine about wheels 12 to effect lowering and raising of pad 19 into and out of contact with floor 14. With reference to FIG. 2, the pad support structure includes a drive plate 22 having a normal horizontal planar position in use and which is adapted for support of a disc-shaped buffing pad 19 at its underside; a shaft 29 secured centrally to plate 22 and extending substantially perpendicular thereto from the upper side thereof and adapted for connection to the motor drive shaft 17; and universally mounted bearing means 30 supporting and journalling shaft 29 for rotation and providing automatic self-adjustment of plate 22 and pad 19 into parallelism with the floor as the thickness of the pad changes with wear.

In greater detail, bearing means 30 here comprises a frame 33; coaxially aligned bearings 31 and 32 mounted in opposed relation on, and internally of, frame 33 for receiving and journally shaft 29; a sheave 34 mounted on shaft 29 within frame 33 and between bearings 31 and 32 and connected by belt 36 to a sheave 37 on motor drive shaft 17; a pair of shafts 38 and 39 secured to frame 33 and extending from opposite sides 41 and 42 thereof and on a common axis intersecting at right angles the axis of shaft 29; and bearings 43 and 44 here carried on machine frame sides 46 and 47 receiving and journalling shafts 38 and 39. As will be observed, the common axis of shafts 38 and 39 here lies substantially in the plane of rotation of sheave 34.

As will be observed from the drawings, the rotating pad support structure is here formed of a substantially circular flat disc-shaped plate 51 having a diameter substantially equal to the diameter of the standard commercial fibrous "hogs hair"-type floor buffing pad, commonly 16–18 inches, and is fastened to the underside of drive plate 22 concentrically therewith by means of a plurality of bolts 52 threaded through aligned openings in plates 51 and 22 in substantially equally circumferentially spaced relation around the center of the plates. A drive ratio is selected as between sheaves 34 and 37 and the load rpm of the motor to provide a rotating speed of the pad of at least about 1,000 rpm. A common speed range for this type of machine is from about 900–1,000 rpm on the low side to about 1,500–1,600 rpm on the high side. It is essential that the motor have sufficient power to drive the buffing pad at such elevated speeds.

Pad 19 is usually a standard, commercially available, fibrous "hogs hair"-type pad fabricated as a mass of bristles held together by a latex or similar binding material. Normally, the pad has a thickness of about 1 inch. Demountable securing of pad 19 to the underside of plate 51 is here effected by bolt 54, passed through the center of pad 19 and threaded into an opening 56 provided in drive plate 22 on the axis of shaft 29. A washer 57 may be placed under the head of bolt 54 for increasing the cinching area on pad 19. Due to the open mesh compressive nature of pad 19, bolt 54 will normally be tightened, as illustrated in FIG. 2, to secure the pad in place.

What is claimed is:

1. A floor buffing machine comprising:
   - a chassis;
   - a pair of chassis mounted floor engaging wheels mounted on a common axis of rotation for movement over the floor to be buffed;
   - a motor drive carried by said chassis;
   - a buffing pad support member having a pair of spaced apart oppositely extending first shafts journaled on said chassis along a common normally substantially horizontal axis parallel to said wheel axis and offset therefrom for movement toward and away from the floor upon pivoting said chassis around said wheel axis;

a drive plate having a normal horizontal planar position in use and adapted for support of a disc-shaped buffing pad at the underside thereof;

a third shaft secured centrally to said plate and extending substantially perpendicular thereto from the upper side thereof, said third shaft being journaled by said member along an axis extending between said first shafts and intersecting and perpendicular to said common axis thereof; and a belt sheave mounted on said third shaft in the plane of said common axis and adapted for belt driven connection to said motor drive.

2. The machine of claim 1, said motor drive having a normally vertically set drive shaft; and a sheave mounted on and driven by said last-named shaft in substantially the plane of said first-named sheave.

3. The machine of claim 1, said member comprising:

a frame with said first shafts projecting oppositely outward from opposite sides of said frame;

a pair of coaxially aligned bearings carried by said frame and receiving and journaling said third shaft; and said sheave being mounted on said third shaft within the interior of said frame.

* * * * *

UNITED STATES PATENT AND TRADEMARK OFFICE

CERTIFICATE OF CORRECTION

PATENT NO. : 4,155,138

DATED : May 22, 1979

INVENTOR(S) : BURKE R. FALLEN

It is certified that error appears in the above-identified patent and that said Letters Patent are hereby corrected as shown below:

[76] Inventor: Delete "Burke F. Fallen" and insert ---Burke R. Fallen---.

Signed and Sealed this

*Second* Day of *October 1979*

[SEAL]

*Attest:*

RUTH C. MASON
*Attesting Officer*

LUTRELLE F. PARKER
*Acting Commissioner of Patents and Trademarks*